United States Patent [19]

Wolske

[11] 3,961,459

[45] June 8, 1976

[54] METHOD OF AND APPARATUS FOR WRAPPING A LOAD IN A WRAPPER OF STRETCHABLE MATERIAL

[75] Inventor: Eugene H. Wolske, Minnetonka, Mich.

[73] Assignee: Bemis Company, Inc., Minneapolis, Minn.

[22] Filed: Apr. 16, 1974

[21] Appl. No.: 461,306

[52] U.S. Cl. ..... 53/24; 53/30 R; 53/124 A; 53/184 R; 53/384

[51] Int. Cl.[2] ..... B65B 43/26; B65B 63/02

[58] Field of Search ..... 53/24, 29, 30, 33, 35, 53/124 A, 183, 184, 255, 258–262, 384

[56] References Cited

UNITED STATES PATENTS

| | | | |
|---|---|---|---|
| 2,884,328 | 4/1959 | Johnson | 53/261 X |
| 2,939,259 | 6/1960 | Hechler | 53/35 X |
| 3,254,472 | 6/1966 | Clark et al. | 53/259 |
| 3,614,849 | 10/1971 | Croucher | 53/24 X |
| 3,714,756 | 2/1973 | MacInnes et al. | 53/48 |

*Primary Examiner*—Robert L. Spruill
*Attorney, Agent, or Firm*—Koenig, Senniger, Powers and Leavitt

[57] ABSTRACT

A method of and apparatus for wrapping palletized loads, utilizing an open-mouth bag of a stretchable plastic film as the wrapper, involving opening the bag and stretching it, bringing the bottom of the bag into engagement with the top of the palletized load, and moving the bag downward to evert it over the load with accompanying shrinking of the bag on the load.

8 Claims, 14 Drawing Figures

METHOD OF AND APPARATUS FOR WRAPPING A LOAD IN A WRAPPER OF STRETCHABLE MATERIAL

BACKGROUND OF THE INVENTION

This invention relates to methods of and apparatus for wrapping, and more particularly to a method of and apparatus for wrapping palletized loads.

The invention is especially concerned with tightly covering loaded pallets with plastic shrouds, such covering being useful to reduce palletizing costs, to contain the load on a pallet, to discourage theft and pilferage, to improve outdoor weatherability, to provide a visual coding system for inventory control by using color additives in the plastic film, etc. Generally there have been two basic systems for effecting such a covering operation, which may be broadly classified as (1) stretch systems and (2) shrink systems. In the stretch systems as heretofore employed, plastic film from a roll or rolls thereof has been wrapped around the load under tension and sealed, the film then shrinking on the load. A problem with these prior stretch systems has been that the wrapping with film from a roll or rolls does not per se provide a covering for the top of the load, and, if a top cover is required, separate and usually manual operations are required to provide a top cover; e.g., a top cover is draped over the load, and film is wrapped around the sides of the top cover to anchor it in place. In the shrink systems as heretofore employed, generally a cover of heat-shrinkable plastic film is applied over the load, the cover being heated (as by conveying the loaded pallets with the covers thereon through a shrink tunnel or oven, or by means of a heater ring surrounding the load and traversed vertically relative to the load. Problems involved with these shrink systems are cost (cost of shrink film and cost of energy for heating), and, in many instances, impracticability or impossibility of heating; e.g., heating of the product on the pallet may be impractical or dangerous, or use of a heating device may be impractical or dangerous in a particular environment. For example, use of a heating device in a food freezer plant or an air-conditioned production area may be impractical, and use of a heating device in an explosive atmosphere would be dangerous. Also, shrink systems are impractical in cases where the load consists of a product packaged in bags of polyethylene or other heat-sealable material since the wrapper may become heat-sealed to the bags.

SUMMARY OF THE INVENTION

Among the several objects of this invention may be noted the provision of an improved method of and apparatus for wrapping palletized loads of the stretch system type to avoid the problems of the shrink systems, while attaining coverage of the top of the load without extra operations; the provision of such a method and apparatus which are economical for moderate and small-volume users, and especially for applications requiring coverage of the top of the load; the provision of such a method and apparatus which effect wrapping of a palletized load with a wrapper providing an integral cover for the top of the load; the provision of such a method and apparatus which attain relatively high binding force for the wrapper via stretching and subsequent release of the wrapper, and which may enable use of thinner gauge film for the wrapper; and the provision of such a method and apparatus with the additional feature of compression of the load, e.g., to reduce its volume.

In general, the method of this invention involves wrapping an item in a wrapper of stretchable material, utilizing an open-mouth bag of said material as the wrapper. The bag is opened and stretched, and the outside of the bottom of the stretched-open bag is brought into engagement with said item, relative movement of the bag and said item being effected to evert the bag over said item, with accompanying shrinking of the bag on said item.

In general, apparatus of this invention comprises means for stretching the bag open, and means for effecting relative movement of said stretching means and said item to bring the outside of the bottom of the stretched-open bag into engagement with said item and then everting the bag over said item with accompanying shrinking of the bag on said item.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Referring first to FIGS. 1–6, which illustrate the method of the invention, there is indicated at 1 an open-mouth bag of stretchable material, utilized as a wrapper of such material for an item to be wrapped, more particularly the palletized load indicated in its entirety at 3. The bag is generally one made of a generally elastic plastic film, e.g., a polyethylene bag, capable of being substantially stretched and shrinking on release. The pallet per se is indicated at 5 and the load on the pallet is indicated at 7. The girth of the bag, as supplied and before being stretched, is somewhat less than the girth of the palletized load (i.e., the perimeter of the palletized load in a horizontal plane). For example, the girth of the bag before it is stretched may be 5% less than the perimeter of the load. The length (height) of the bag is sufficient to cover the load.

Figure 1:
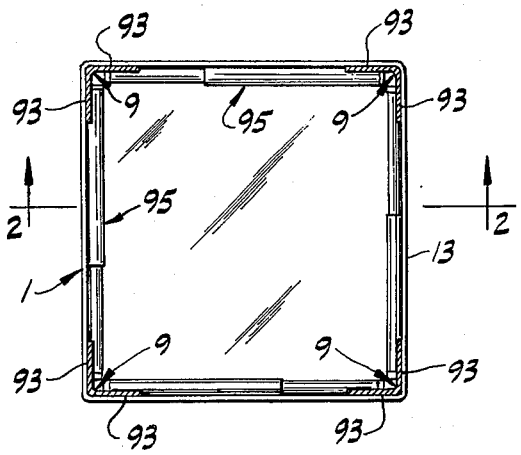
FIG. 1 is a plan illustrating an initial step in the method of this invention involving the opening of a plastic bag and its application to a set of stretcher members.
Figure 3:
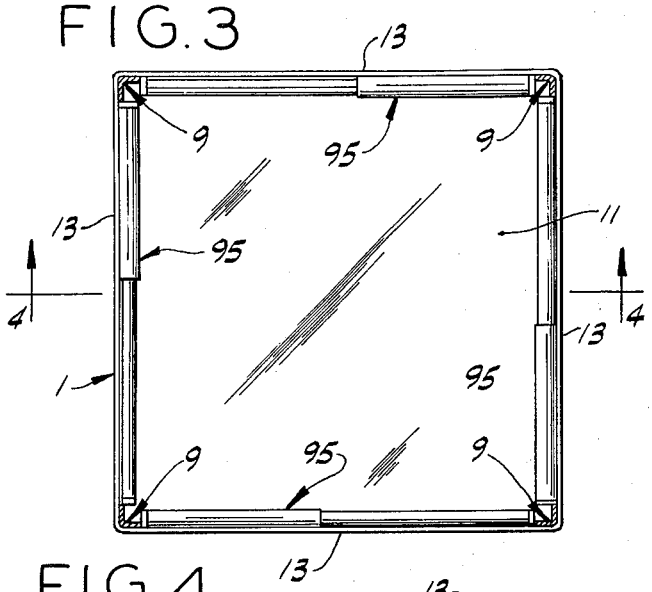
FIG. 3 is a view similar to FIG. 1 showing the bag stretched.
Figure 2:
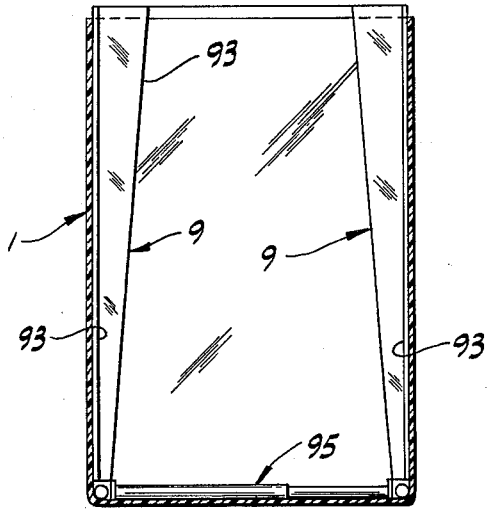
FIG. 2 is a view in vertical section on line 2—2 of FIG. 1.
Figure 4:
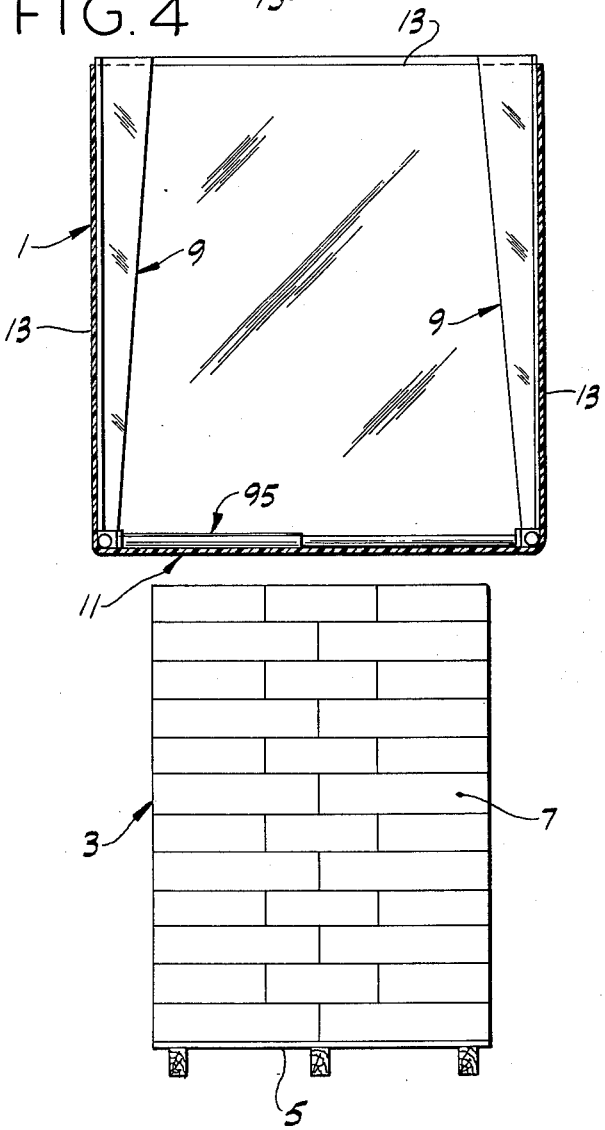
FIG. 4 is a view in vertical section on line 4—4 of FIG. 3, and showing the stretched bag in position above a palletized load.

In carrying out the method of this invention, the bag is opened and stretched to a point where its girth is greater than the girth of the load. It may be stretched about 20%, for example. As shown in FIGS. 1 and 2, the bag is opened and applied to a set of four stretcher members each designated 9, located at the corners of a square, which are then moved diagonally (radially) outwardly to stretch the bag as illustrated in FIGS. 3 and 4. This forms the bag with a square bottom 11 somewhat larger than the horizontal section of the load and four sides each designated 13 and each somewhat wider than the width of a side of the load.

Figure 5:
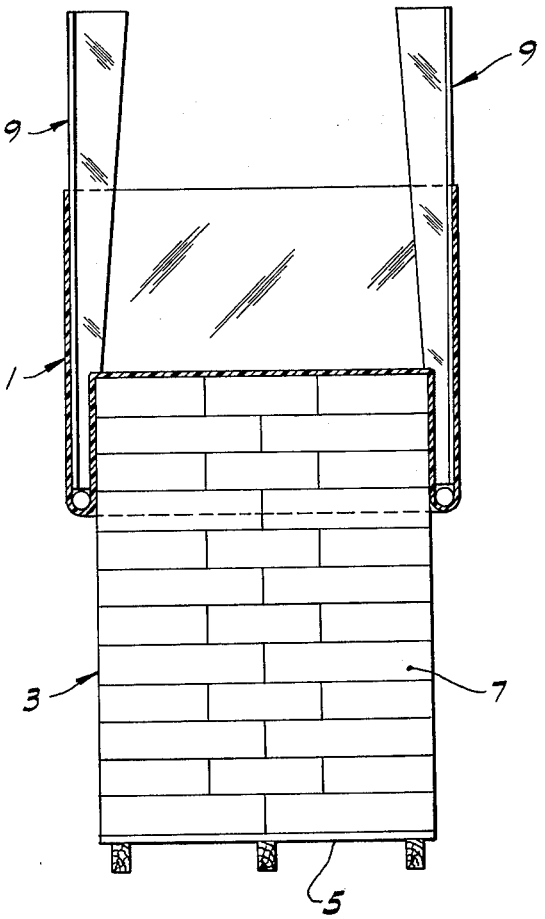
FIG. 5 is a view similar to FIG. 4 showing the bag in the process of being applied over the load.
Figure 6:
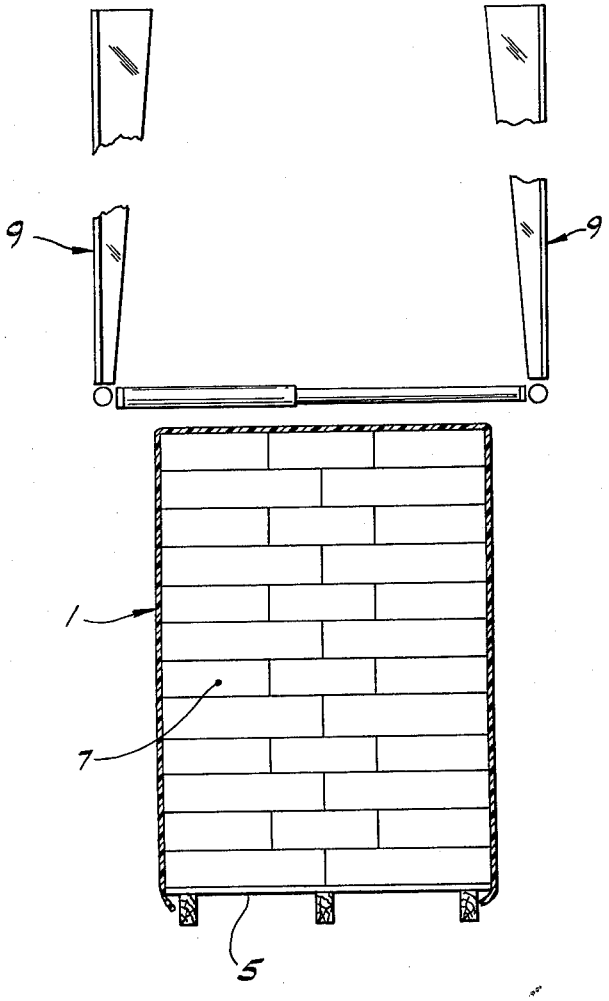
FIG. 6 is a view similar to FIG. 5 showing the bag applied to the load and the stretching members raised.
Figure 7:
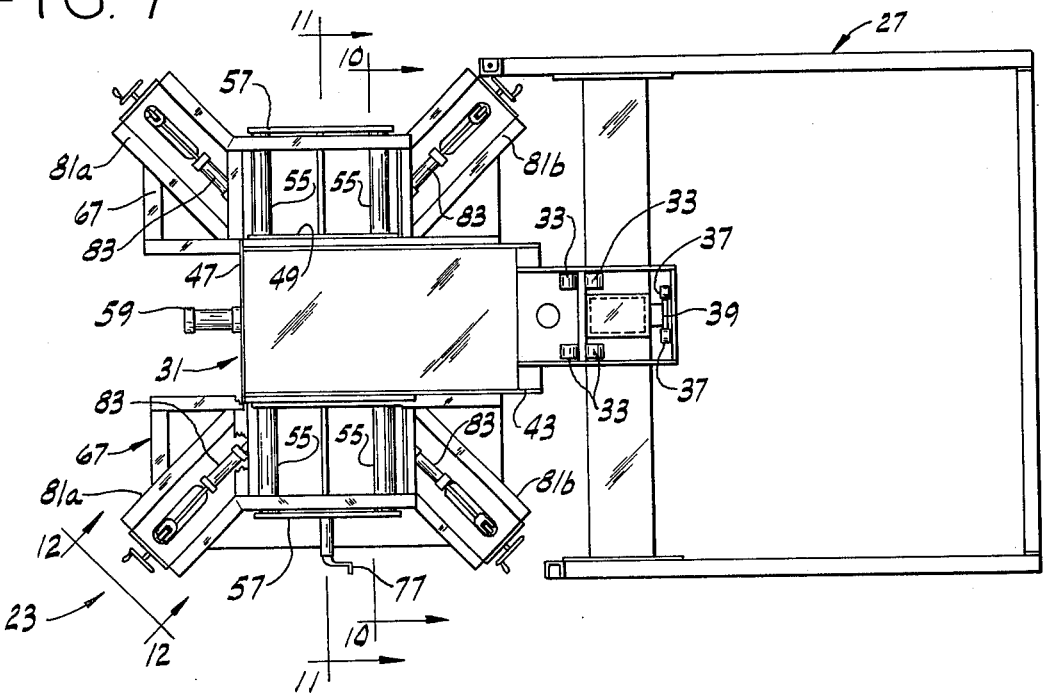
FIG. 7 is a plan of apparatus of this invention for carrying out the method illustrated in FIGS. 1–6.

As shown in FIGS. 1 and 2, the bag is applied to the stretcher members 9 bottom down, and, as shown in FIG. 4, is positioned above the load 7 on the pallet 5. The outside of the bottom 11 of the stretched-open bag (its bottom face as viewed in FIG. 4) is brought into engagement with the top of the load 7, and relative movement is effected between the bag 1 and the load 7 to evert the bag over the load (i.e., to turn it inside out over the load) with accompanying shrinking of the bag on the load as the bag comes off the lower ends of the stretcher members 9. In this manner the bag is applied to and shrunk tightly on the load, accomplishing so-called stretch-palletizing. Generally, the bottom 11 of the bag is brought down into engagement with the top of the load 7 and the bag is moved downward relative to the load to evert it over the load, although it is possible that the load may be moved upward without moving the bag downward, or the bag may be moved downward and the load moved upward. FIG. 5 shows the bag in the act of being moved downwardly and everted over the load. After the bag has been fully everted and applied to the load, the stretcher members 9 are raised above the covered load, as illustrated in FIG. 6.

To facilitate stripping of the bag from the stretcher members 9, they may be retracted to some extent to relax the stretch of the bag as it is everted. The relaxation of the stretch reduces the force required to strip the bag from the members 9.

It is contemplated that the load 7 may be compressed during the wrapping operation above described, as by compression of the load through the bag bottom (which becomes the top of the wrapper on the load). This is particularly useful in the case of loads which have entrapped air, such as a load of stacked multiwall bags, in order to squeeze out the air.

Figure 8:
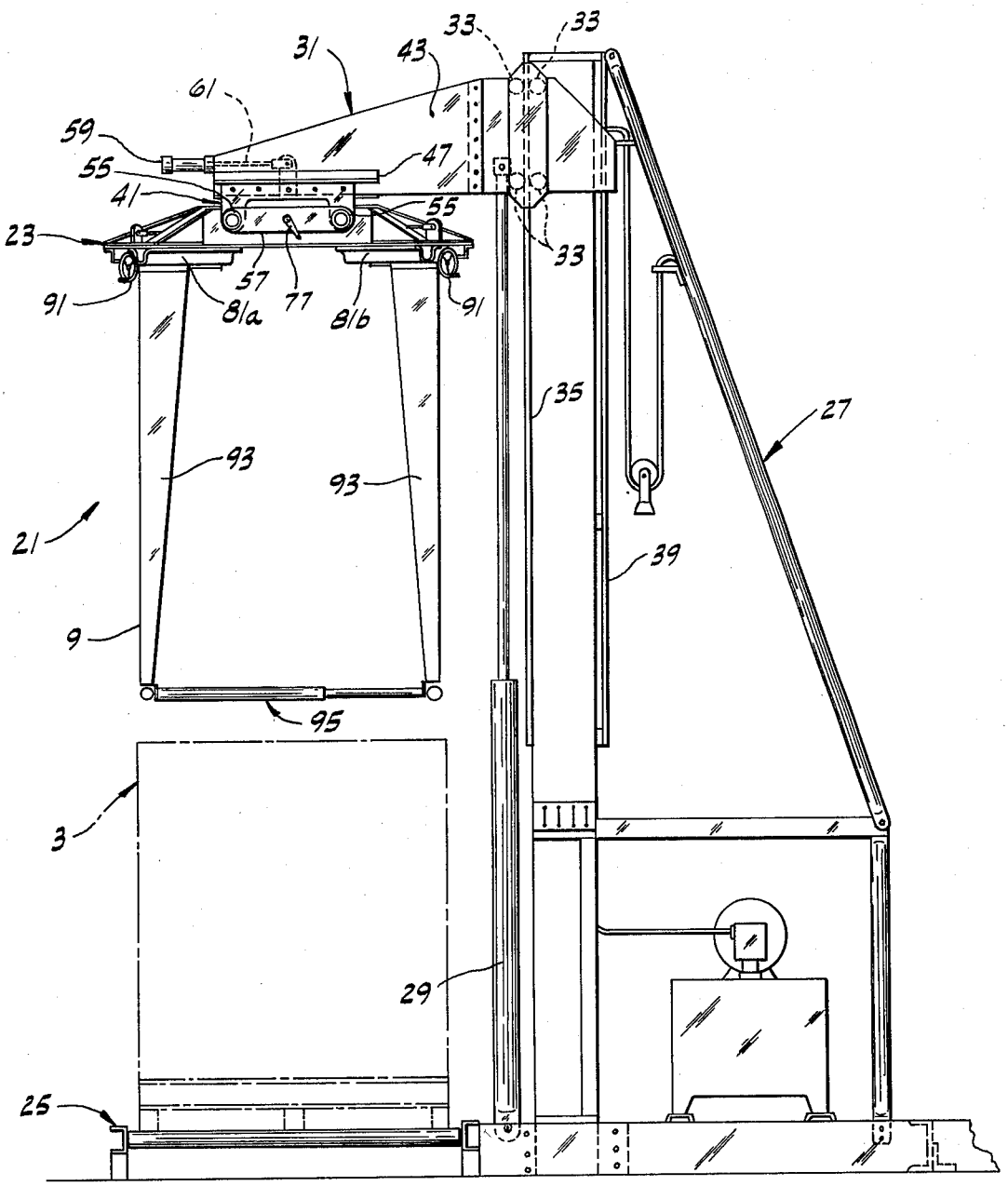
FIG. 8 is an end elevation of the apparatus, showing a stretcher bar unit thereof in its raised position with certain stretcher bars thereof in a retracted position.
Figure 9:
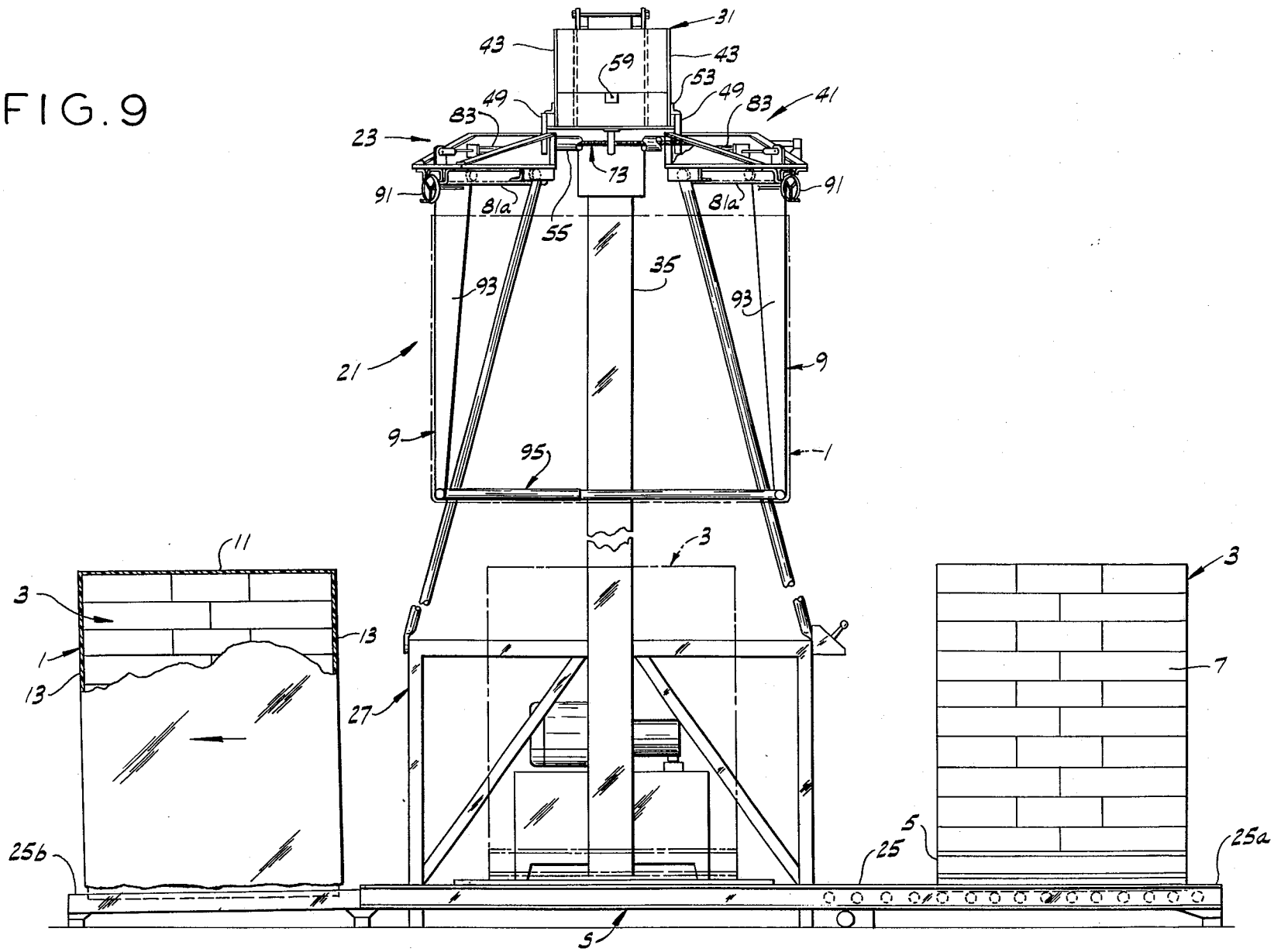
FIG. 9 is a front elevation of the apparatus showing the stretcher bars in an expanded position for stretching a bag, the bag being shown in phantom on the bars.
Figure 10:
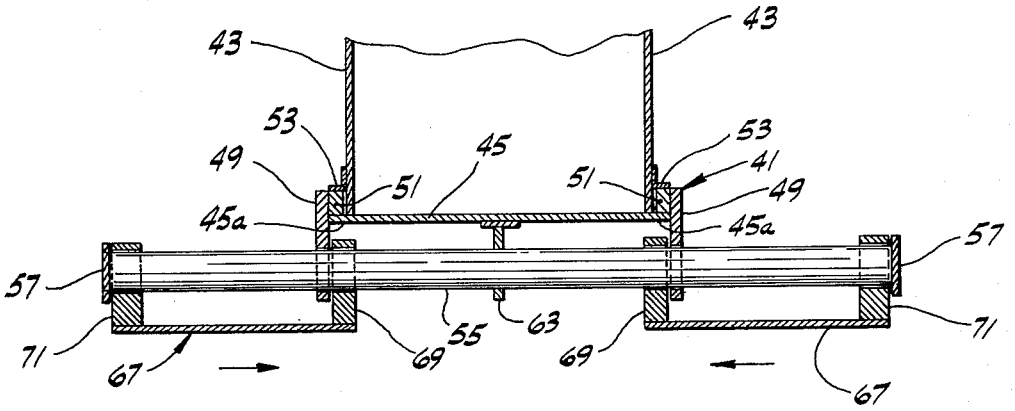
FIG. 10 is an enlarged vertical section on line 10—10 of FIG. 7, with parts broken away.
Figure 11:
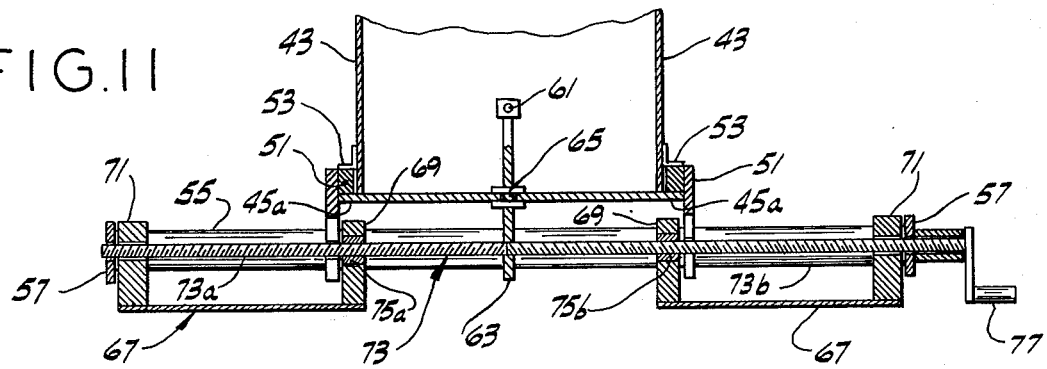
FIG. 11 is an enlarged vertical section on line 11—11 of FIG. 7, with parts broken away.
Figure 12:
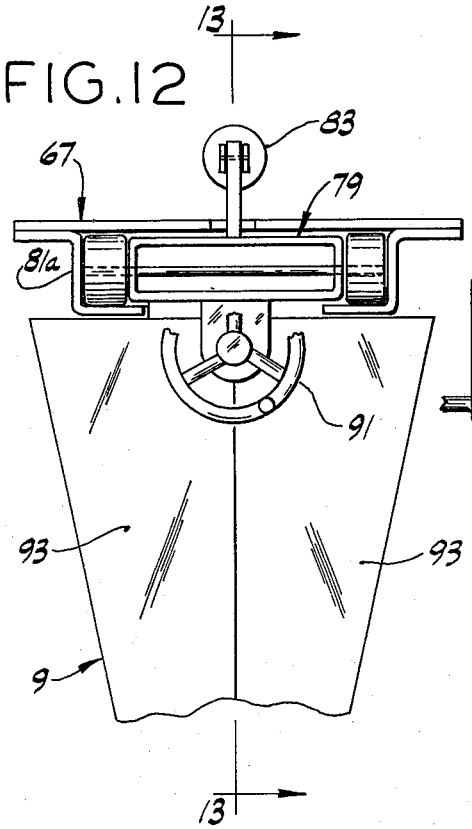
FIG. 12 is an enlarged vertical elevation on line 12—12 of FIG. 7.
Figure 13:
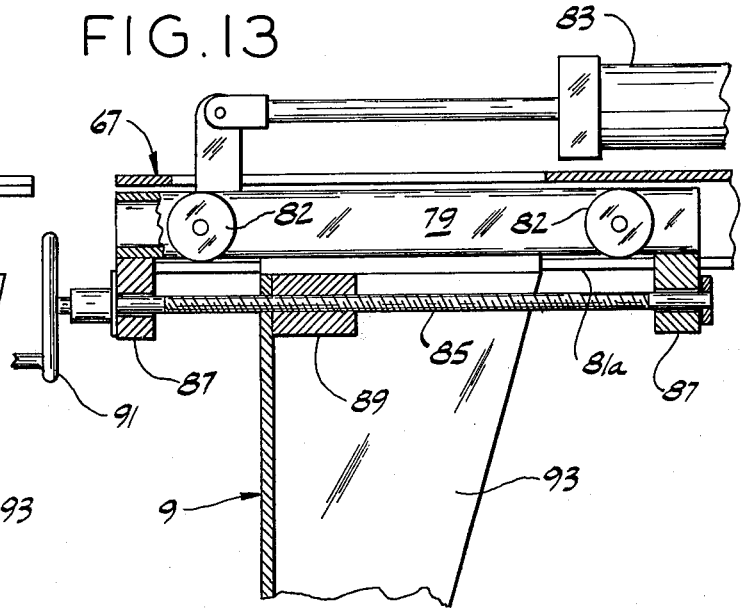
FIG. 13 is a vertical section on line 13—13 of FIG. 12.

Now referring to FIGS. 7–13, apparatus of this invention is shown basically to comprise means indicated generally at 21 for stretching the bag 1 open, including the four aforesaid stretcher members 9, and elevator means indicated generally at 23 for effecting the relative movement of the stretching means 21 and the load to bring the outside of the bottom 11 of the stretched-open bag into engagement with the load and then everting the bag over the load, with accompanying shrinking of the bag on the load. More particularly, said apparatus comprises a roller conveyor 25 on which palletized loads 3 may be rolled from one end **25*a* constituting the entrance end of the conveyor to a wrapping station S for the stretch-palletizing operation and then rolled from station S to the exit end 25*b* of the conveyor. At the wrapping station S, at one side of the roller conveyor, is a framework or tower 27 on which the elevator means 23 is vertically movable by means of a relatively long hydraulic cylinder 29. The elevator means comprises a main carriage 31 having rollers 33 (see FIG. 7) engageable with a vertical track 35 constituted by a vertical plate on the side of the tower toward the conveyor, and a pair of back or outboard rollers 37 (see FIG. 7) engageable with a vertical guide bar 39 on the tower. The main carriage 31 is cantilevered horizontally forward from the tower over the conveyor 25, and is movable by means of cylinder 29 downwardly toward the conveyor from the raised retracted position in which it is shown in FIGS. 8 and 9** and back up to retracted position.

An auxiliary carriage 41 is movable in and out (i.e., toward and away from the tower 27) on the main carriage 31 of the elevator. The main carriage has a pair of vertical side plates each designated 43, a bottom plate 45 and a front plate 47. The auxiliary carriage 41 comprises a pair of side plates each designated 49 and each having a guide bar 51 slidable on laterally projecting portions **45*a* (see FIGS. 10 and 11) of the main carriage bottom plate 45, angle irons 53 being provided on the outside of the main carriage side plates 43 to hold down the guide bars. Two tubular guide rods each designated 55 extend through the side plates 49 of the auxiliary carriage, being fixed in these plates projecting laterally outwardly therefrom. The guide rods 55 have end plates 57 at their outer ends. The auxiliary carriage 41 (comprising the plates 49, guide bars 51, guide rods 55 and plates 57) is movable in and out on the main carriage (by the sliding of the bars 51 in the tracks provided therefor by the laterally projecting portions 45*a* of the main carriage bottom plate 45 and the angle irons 53) via a hydraulic cylinder 59 mounted on the main carriage front plate 47 having its piston rod 61 connected to a center plate 63 of the auxiliary carriage, this plate 63 being slidable in a slot 65 in the main carriage bottom plate 45.**

The auxiliary carriage 41 carries a pair of slide members each designated 67 at opposite sides thereof mounted for sliding movement toward and away from one another laterally with respect to the main and auxiliary carriages 31 and 41 (longitudinally with respect to conveyor 25) on the guide rods 55. Each slide member 67 comprises a frame having a guide member 69 on the inside of the respective auxiliary carriage plate 49 and a guide member 71 spaced outwardly from member 69 on the outside of plate 49 and on the inside of the respective auxiliary carriage end plate 57, the stated guide members 69 and 71 having holes receiving the guide rods 55 with a sliding fit so that the members 67 may be adjusted in and out relative to the auxiliary carriage 41. This in and out adjustment of the slide members 67 is effected by means of an adjustment screw 73 journalled in the auxiliary carriage end plates 57 and in the center plate 63, having oppositely threaded portions **73*a* and 73*b* threaded in nuts 75*a* and 75*b* on the two slide members 67 with a crank 77** for turning the screw in one direction or the other to move the slides in unison in and out toward and away from one another.

Each slide member 67 carries a pair of carriages or heads 79 movable diagonally inwardly and outwardly at the front and rear end of the slide, the stretcher members 9 extending vertically downwardly from these heads. The arrangement is such that the heads and stretcher members 9 may occupy positions at the corners of a rectangle, usually a square as illustrated in FIG. 1. Each member 67 has a front track 81*a* extending forward and angled 45° laterally outwardly with respect to the member 67, and a rear track 81*b* extending rearward and also angled 45° laterally outwardly with respect to the member 67. Each of the heads 79 has rollers 82 mounting it in its respective track for movement outwardly from an inner retracted position to move the stretcher members 9 diagonally (radially) outwardly for stretching a bag 1 applied to members 9. Each head 79 is moved in and out via a hydraulic cylinder 83 on the respective member 67.

Each stretcher member 9 is constituted by a bar extending vertically downwardly from the respective head 79 with provision for adjusting the bar in and out relative to the head via an adjusting screw 85 mounted as indicated at 87 below the head, extending longitudinally of the head and in threaded engagement with a nut 89 on the bar at its upper end. The screw has a handwheel 91 at its outer end for turning it. Each bar 9 is of angle shape in cross section and tapered from its upper to its lower end. The bars 9 are arranged as appears in FIG. 1 with their flanges 93 in four planes forming the four sides of a rectangle and with the junctures of the flanges (i.e., the corners of the bars) toward the outside and forming the corners of the rectangle. Extending between the lower ends of each pair of bars 9 (there being, in effect, four pairs of bars) is a telescoping guide means 95 constituted by a telescoping roller.

Operation is as follows:

The slide members 67 are adjusted toward or away from one another by turning the screw 73 one way or the other and the stretcher bars 9 are adjusted diagonally in or out by turning the screws 85 one way or the other to adjust the stretcher bars 9 in accordance with the girthwise conformation of the palletized load 3 to be enwrapped (i.e., in accordance with the dimensions of the palletized load longitudinally and laterally in relation to the conveyor 25). This adjustment is such that, with the stretcher bars 9 in their inner retracted position such as illustrated in FIG. 1, the rectangle defined by the bars 9 is somewhat smaller than the rectangular outline in plan (the girth) of the palletized load 3.

With the stretcher bars 9 so adjusted and in their retracted position, and with the elevator 23 and the stretcher bars 9 in the raised position illustrated in FIGS. 8 and 9, the bag 1 is slipped on to the bars 9 from their lower end, where the entire stretching means constituted by the bars 9 is free to receive the bag. As previously mentioned, the girth of the bag in its unstretched condition is somewhat less (e.g., 5% less) than the perimeter of the load, and the size of the rectangle defined by the stretcher bars in their retracted position is such as to enable the bag readily to be slipped on to the bars.

After the bag has been slipped on to the bars 9, the bars are moved diagonally (radially) outwardly by means of the cylinders 83 to stretch the bag, thereby forming it with the square bottom 11 and the four sides 13. The rollers 95 lie at the four sides of the bag bottom 11. Being telescoping rollers, they permit the radial inward and outward movement of the bars 9. The palletized load 3 is moved on the conveyor 25 to the wrapping station S where it is positioned below the raised stretcher bars 9 carrying the stretched bag. The auxiliary carriage 41 may be moved in or out via the cylinder 59 to align the stretcher bar assembly or unit 21 with the palletized load 3. Then, the stretcher bar unit 21 is lowered by means of cylinder 29 to bring the bottom 11 of the bag down into engagement with the top of the load, and the downward movement is continued to evert the bag (i.e., turn it inside out) over the load. As the stretcher bar unit 21 is lowered, and as soon as the bag bottom 11 engages the top of the load, the stretcher bars 9 may be retracted to relax the stretch of the bag as it is everted. This relaxation may be from 5% to 10%, for example, and at high speed to reduce the amount of force required to strip the bag off the bars and on to the load. It will be observed that the stretcher bar unit 21 is open at its lower end (within the rollers 95) for interiorly receiving the load for everting the bag. The sides of the bag are in effect rolled down on the sides of the palletized load by the rollers 95 as they descend. As the bag is everted on the load, and when it has been everted on the load, the stretcher bar unit 21 is moved back up to its raised position by cylinder 29, and the enwrapped pallet is moved forward on conveyor 25 away from the wrapping station S.

Figure 14:
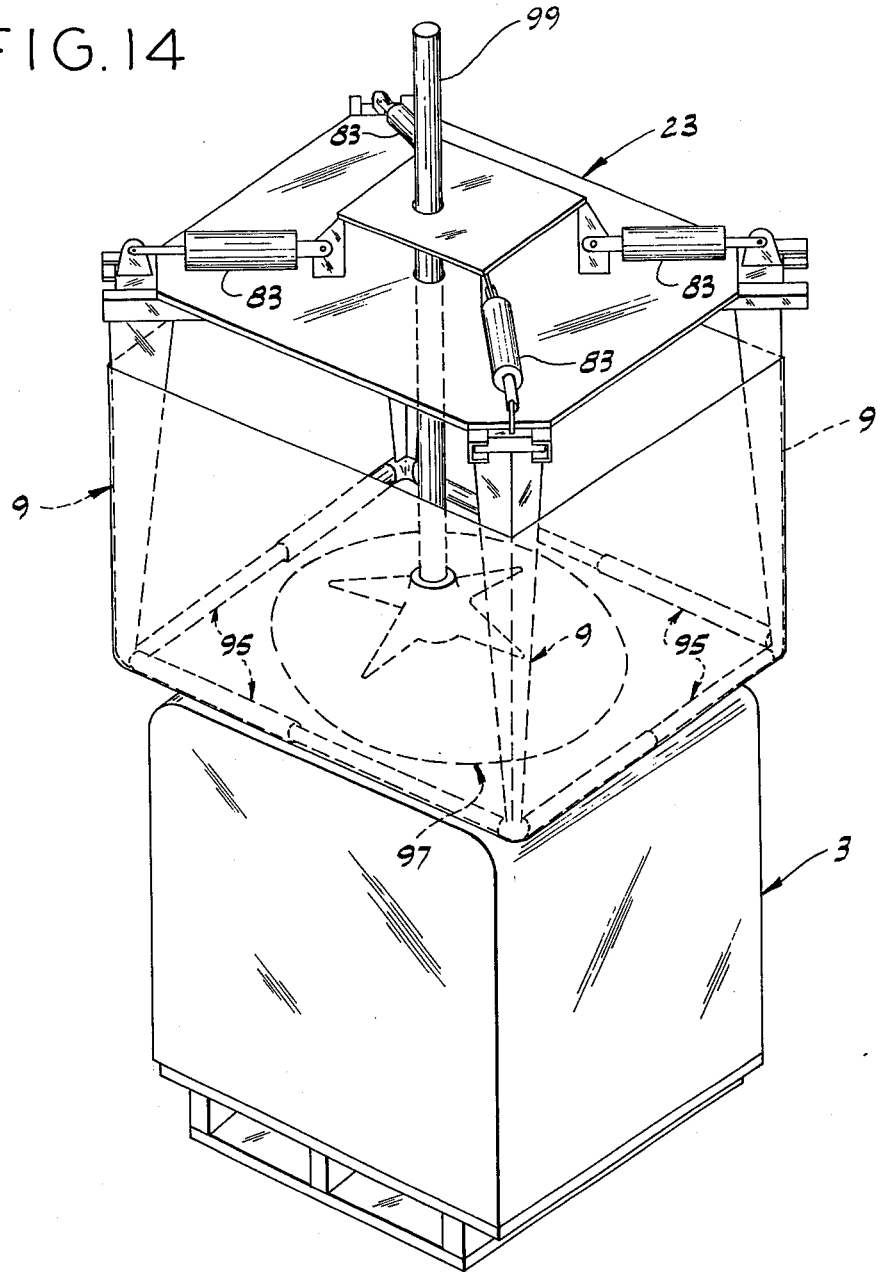
FIG. 14 is a view of a modification for effecting compression of a load.

FIG. 14 shows a modification for enwrapping a compressible item or load and compressing the item or load during the everting of the bag thereover, e.g., to reduce the volume of the load (squeeze entrapped air out of the load). In this modification, a platen 97 for effecting compression of the load is mounted within the stretcher bars 9 for vertical movement relative to the stretcher bars. As shown generally diagrammatically in FIG. 14, the platen is at the lower end of a rod 99 vertically slidable in the elevator 23, and is relatively heavy so as to be capable of exerting a sufficient force on the load to compress it. The platen is held up by suitable means as the elevator is lowered until the bottom 11 of the stretched bag engages the top of the load. Then the platen is released to bear down on the load (through the bottom 11 of the bag) and compress the load as the bag is everted over the load.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. The method of wrapping an item, such as a palletized load, in a wrapper of stretchable material, utilizing an open-mouth bag of said material as the wrapper, the girth of the bag when unstressed being smaller than the girth of said item, comprising: applying the bag over a plurality of stretcher members, moving said members outwardly within the bag to stretch the bag to a size larger than said item, bringing the outside of the bottom of the bag stretched on said stretcher members down into engagement with the top of said item and moving said members downwardly relative to said item to strip the bag from said members and evert the bag over said item while retracting said members inwardly as they move downwardly relative to said item to relax the stretch of the bag as it is everted thereby to reduce the force required to strip the bag from said members.

2. The method of claim 1 wherein said item is compressed through the bottom of the bag during the downward movement of said members.

3. Apparatus for wrapping a palletized load in a wrapper of stretchable material, utilizing an open-mouth bag of said material as the wrapper, comprising an elevator, means for moving the elevator down from a raised retracted position and back up to retracted position, and means carried by the elevator for stretching a bag open comprising a plurality of bars extending down from the elevator, means mounting the bars at their upper ends on the elevator for movement out from a retracted position to expand a bag applied over the bars and for movement back in to their retracted position, and means carried by the elevator for moving the bars out and in, the bars having telescoping guide means extending between their lower ends.

4. Apparatus as set forth in claim 3 having means for adjustment of the retracted position of the bars.

5. Apparatus as set forth in claim 4 having a conveyor extending under the elevator for bringing a palletized load into position below the bars when the elevator is in its raised retracted position.

6. Apparatus as set forth in claim 5 wherein the elevator comprises a main carriage and an auxiliary carriage carrying the bars movable laterally relative to the conveyor on the main carriage.

7. Apparatus for wrapping a palletized load in a wrapper of stretchable material, utilizing an open-mouth bag of said material as the wrapper, comprising an elevator, means for moving the elevator down from a raised retracted position and back up to retracted position, and means carried by the elevator for stretching a bag open comprising a plurality of bars extending down from the elevator, means mounting the bars at their upper ends on the elevator for movement out from a retracted position to expand a bag applied over the bars and for movement back in to their retracted position, means carried by the elevator for moving the bars out and in, a conveyor extending under the elevator for bringing a palletized load into position below the bars when the elevator is in its raised retracted position, said elevator comprising a main carriage and an auxiliary carriage and wherein the auxiliary carriage carries a pair of members movable toward and away from one another at opposite sides of the auxiliary carriage, the apparatus having a pair of bars extending down from one of said members and a pair of bars extending down from the other of said members, the bars of each pair being movable diagonally inwardly and outwardly at the ends of the respective member.

8. Apparatus as set forth in claim 7 having means for diagonally adjusting the bars.

* * * * *